United States Patent [19]

Hsiao

[11] 4,295,434

[45] Oct. 20, 1981

[54] FEED MECHANISM FOR SEWING MACHINES

[75] Inventor: James C. Hsiao, Morton Grove, Ill.

[73] Assignee: Union Special Corporation, Chicago, Ill.

[21] Appl. No.: 87,906

[22] Filed: Oct. 24, 1979

[51] Int. Cl.[3] ..... D05B 27/02

[52] U.S. Cl. ..... 112/314; 112/323

[58] Field of Search ..... 112/323, 314, 317, 319

[56] References Cited

U.S. PATENT DOCUMENTS

| | | | |
|---|---|---|---|
| 558,663 | 4/1896 | Richards | 112/323 |
| 1,054,715 | 3/1913 | Richards | 112/323 |
| 1,543,945 | 6/1925 | Moffatt | 112/314 |
| 1,581,496 | 4/1926 | Weis | 112/314 |
| 1,864,165 | 6/1932 | Allen | 112/158 |
| 2,172,559 | 9/1939 | Kaier | 112/314 |
| 2,303,839 | 12/1942 | Hoza | 112/314 |
| 2,546,939 | 3/1951 | Breul | 112/314 |
| 2,550,553 | 4/1951 | Graesser et al. | 112/314 |
| 2,725,023 | 11/1955 | Ayres | 112/314 |

*Primary Examiner*—H. Hampton Hunter

*Attorney, Agent, or Firm*—John W. Harbst; John A. Schaerli

[57] ABSTRACT

This disclosure relates to a four motion feed mechanism for sewing machines that is adapted to advance a work piece past the stitch forming point of the machine. Orbital movement is imparted to the feed dog by a drive mechanism including first and second linkage assemblies driven off a common eccentric arranged on the sewing machine bed shaft. A feed lift regulatory assembly is operatively connected to one of the linkage assemblies and is provided to selectively modify the amplitude of lift that is imparted to the feed dog of the machine.

20 Claims, 9 Drawing Figures

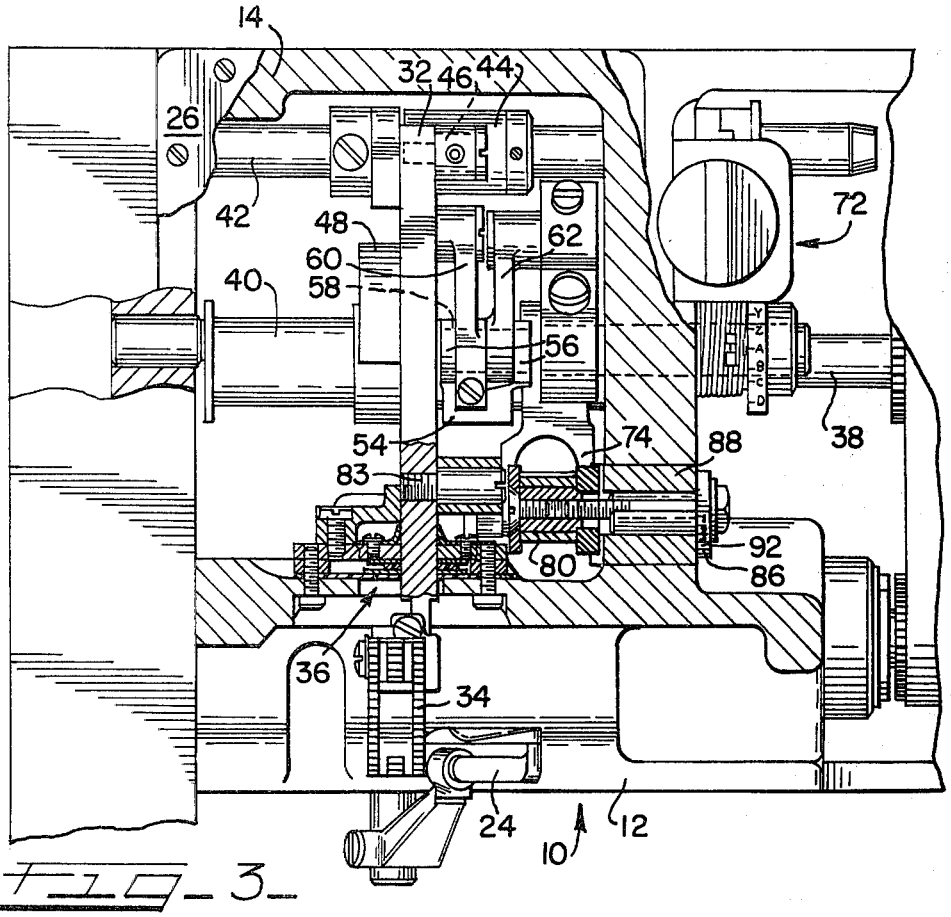
FIG. 3
FIG. 4
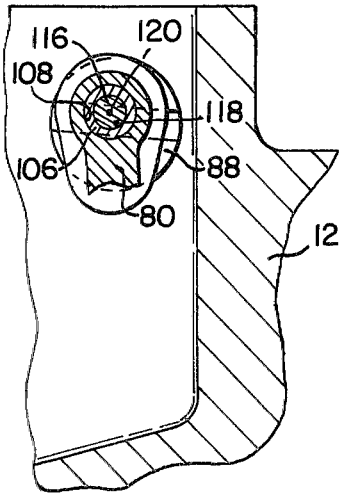
FIG. 5
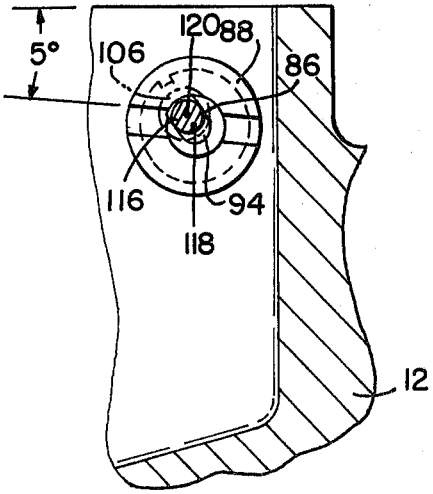

116
92
86
90
94
120
88
102
98
100
104
110
85
106
80
108
114
112

87
52
85
80
78
82
81
83
74
54
40
59
66
62
50
38
60
68
32
44
46
42

FEED MECHANISM FOR SEWING MACHINES

FIELD OF THE INVENTION

The present invention relates to sewing machines and, more particularly, to a feed mechanism for sewing machines.

BACKGROUND OF THE INVENTION

As is understood, four motion feed mechanisms (also known as drop feed mechanisms) have been known for a number of years. With this particular type mechanism, movement of the feed dog means is comprised of two components; namely, a height-wise movement known as feed "lift" and a horizontal movement known as feed "advance" or "return". In an industry, such as sewing, wherein it is necessary to handle varying type workpieces, ranging from denim to the lightest lingerie, it has been considered desirable to provide a sewing machine with adjustable "lift" motion. An adjustable "lift" motion is desirable because the sewing of materials of different thicknessess or weight requires different magnitudes of feed lift. That is, heavy material, i.e. denim or wool, requires a greater feed lift than lighter material, i.e. silk.

Many of today's machines have fixed feed lift eccentrics. Accordingly, these machines are limited in use as to the type of materials which can be sewn thereon. In one class of sewing machines it has generally been the practice to employ replaceable eccentrics for varying the feed lift. However, a major drawback associated with the use of replaceable eccentrics is the amount of "down time" that the operator must incur in order to change the feed lift of the machine. The heretofore known feeding mechanisms which employed fixed or replaceable eccentrics lack the advantages of the arrangement according to the present invention which employs a new and unique feed mechanism which is designed to permit precise adjustment of the feed mechanism of the machine. Still another constraint that was necessarily weighed during the formulation of the present invention was to design a mechanism wherein it may be possible to adjust or change the feed lift of the machine without correspondingly affecting the feed advance or stitch length.

Sewing machines are known from U.S. Pat. No. 558,663 and No. 2,725,023 wherein the feed "height" is adjustable. That is, the distance the feed dog extends above the work support of the machine. It is important to note that with this type machine, the feed "lift" is not adjustable, but the orbital path traversed by the feed dogs during the operation of the machine is merely raised relative to the throat plate of the machine. As may readily be appreciated by one skilled in the art, a major drawback with merely adjusting the feed height, so as to compensate for workpieces of varying thickness or weight, is the backwards feeding that is incurred when such adjustment is made. Additionally, the raising of the feed dog results in an increased duration of feed above the throat plate.

SUMMARY OF THE INVENTION

In view of the above, and in accordance with the present invention, there is provided a feed mechanism that is arranged in the machine frame for incrementally advancing a workpiece past the sewing instrumentalities of the machine. The feed mechanism of the present invention includes feed bar means and feed dog means carried thereby, a first linkage assembly for imparting a horizontal feed motion to said feed bar means and a second linkage assembly for simultaneously moving the feed bar means in a vertical direction whereby moving the feed dog means in a generally orbital path. Both the first and second linkage assemblies derive their motion from a common eccentric fixedly secured on a shaft revolubly mounted in the frame of the machine. In the presently preferred embodiment, the second linkage assembly includes a pitman that is associated with the eccentric, an arm adapted to connect the free end of the pitman to the feed bar means of the machine, and an anchor link. The anchor link is effective to translate the movements of the pitman into endwise movement of said arm, whereby imparting vertical movement to said feed bar means and to the feed dog means carried thereby. The anchor link is pivoted at one end to a feed regulating assembly means, the operative position of which regulates the magnitude of feed lift that is imparted to the feed dog means. That is, the feed regulatory assembly is adapted to control the output motion of the second linkage assembly whereby enabling the magnitude of the orbital motion imparted to said feed dog means to be controlled within predetermined limits. An advantage of the present invention is that it allows for a change in the feed lift without changing the amount of time that the feed dog is above the throat plate of the machine. In one embodiment, the feed regulatory means is comprised of an assemblage of elements including guide block means having a pivot pin for securing the free end of said anchor link, manually operable means for selectively shifting the pivot point for said anchor link with respect to the eccentric employed for actuating said second link assembly and fastening means for securing said guide block and pivot pin in an adjustably regulated position.

In line with the above, it is a primary object of this invention to provide a simple and effective feed mechanism that is capable of advancing a workpiece past the stitch forming instrumentalities of the machine.

Another object of the invention is the provision of a feed mechanism, the orbital movement of which is the product of two independent linkage systems that are actuated by a single crank.

A distinct advantage of the present invention over the known prior art is the provision of a feed mechanism having means operative at the will of the operator for governing the amplitude of feed lift movements.

Still another object of the present invention is to provide a regulatable feeding mechanism for sewing machines in which the feed lift of the feed dog may be selectively adjusted by the operator to meet the various conditions of operation without correspondingly affecting the feed advance and return movements of the mechanism.

BRIEF DESCRIPTION OF THE DRAWINGS

Having in mind the above objects and other attendant advantages that would be evident from an understanding of this disclosure, the invention comprises the devices, combinations, and arrangements of parts as illustrated in the presently preferred embodiment of the invention which is hereinafter set forth in detail so as to enable those skilled in the art to readily understand the functions, operation, construction and advantages of it when read in conjunction with the accompanying drawings in which:

FIG. 3 represents a top plan view partially shown in section taken along the line 3—3 of FIG. 2;

FIG. 4 represents a detail end view showing the adjustable feed lift assemblage and the end of the anchor link positioned thereby;

FIG. 5 represents a detail end view of the adjustable feed lift assemblage.

DETAILED DESCRIPTION OF THE PREFERRED EMBODIMENT

Figure 1:
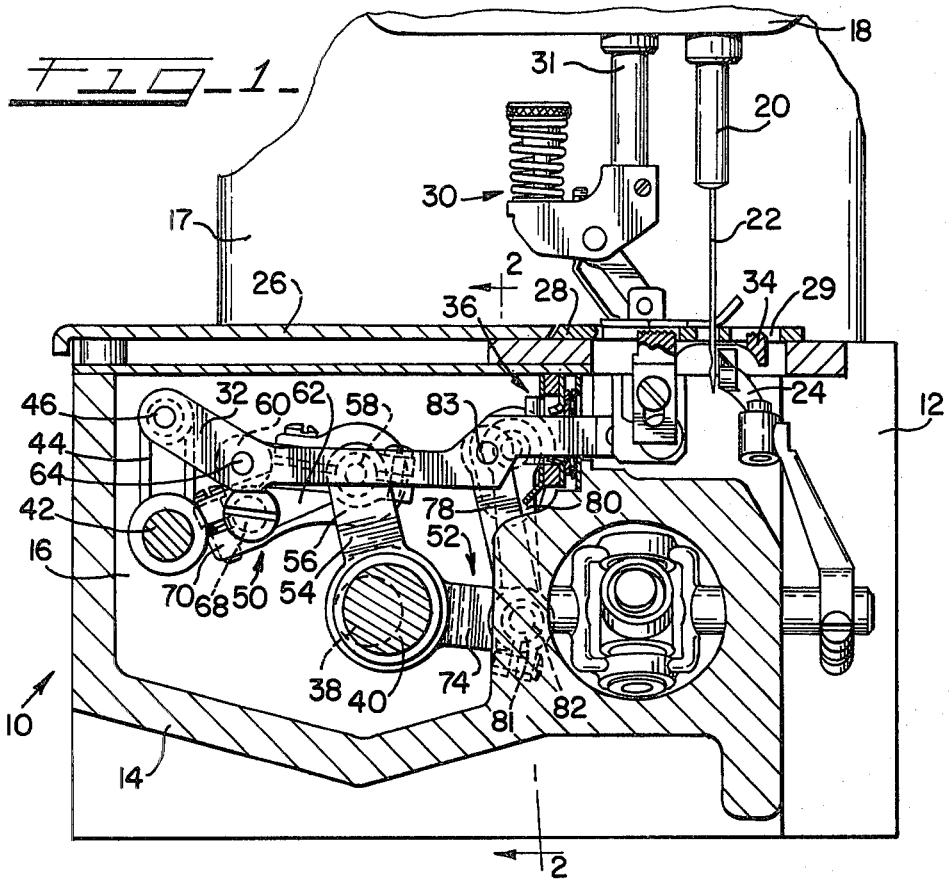
FIG. 1 represents a partial end elevational view of a sewing machine with a vertical section taken substantially through the work support and a portion of the frame broken away so as to illustrate a preferred embodiment of the present invention.

Referring now in more detail to the drawings, in which like reference numerals indicate like parts throughout the several views, only so much of a sewing machine is shown as is deemed necessary to illustrate the application and mode of operation of a presently preferred embodiment of the invention. The improved feed mechanism hereunder consideration is shown as applied to a sewing machine having a housing generally designated as 10, comprising a base or frame 12 from which extends a hollow arm 14, having a machine chamber means 16 formed at one end thereof. Rising from and detachably secured to the other end of the bed, is the standard 17 which supports a bracket arm (not shown) terminating in a hollow sewing head 18 which overhangs the free end of the arm 14. Mounted for endwise reciprocation in the head is a needle bar means 20 which carries, at its lower end, thread carrying needle means 22. The needle means 22 is adapted to cooperate with suitable loop taker means 24, as is well known in the art, to form stitches at a stitching point. During operation of the machine, the workpiece being sewn is moved across a work support means 26 and is held against the throat plate 28 by a presser foot assembly means 30 carried on the lower end of a presser bar 31 journaled for endwise sliding movement in the head 18.

The work is adapted to be fed past the stitching instrumentalities by means of a four motion feeding mechanism. The mechanism includes a feed bar means 32, the distal or forward end of which extends beyond the chamber 16 and has secured thereto suitable material engaging gripper or feed dog means 34 that are arranged in an area spaced from said chamber. It will be understood that the feed dog means 34 intermittently rises above the level of the supporting surface of the throat plate 28 through suitable openings 29 provided therein so as to cooperate with said presser foot assembly 30 in advancing the workpiece step-by-step in translation over said work support means and past the needle in the intervals when the latter is disengaged from the work. The feed bar means and feed dog means carried thereby are given the usual "feed" and "return" movements and "rising" and "falling" movements through mechanisms subsequently described.

The type of sewing machine to which the present invention is applied operates at high speeds and the various actuating mechanisms require that lubricant be circulated within the chamber 16. To prevent the lubricant from leaking out of the chamber and thus moving along the feed bar, the machine may be provided with a lubricant sealing device 36, the details of which are described hereinafter.

Revolubly mounted in the frame beneath the work support is a drive shaft 38, one end of which may be formed as an eccentric or crank 40. At a ratio of one to one, the shaft 38 drives, through suitable transmission means well known in the art, the needle drive shaft (not shown) which is revolubly mounted in the head such that the needle and feed mechanism are adapted to move in timed relation relative one another. Also received in the bed of the machine is a rock shaft 42. Arranged on the rock shaft is a rocker arm 44, the upper extremity of which is articulated as at 46 to the rear of the feed bar means 32. The feed bar means is further connected to a drive mechanism means including connections for operatively associating the feed bar means 32 with the eccentric or crank 40. The subject drive mechanism is effective to impart movement to the feed bar means in mutually perpendicular or orthogonal directions. One direction being transversely across said bed to provide work advancing and return movements to said feed dog means. The other direction being toward or away from said work support so as to "lift" the feed dog means to a position above the work support during the work advancing movement and to lower the feed dog means to position below the work support during the return movement. In one embodiment, the drive mechanism for imparting movement to the feed bar includes first and second independent linkage assemblies, generally designated 50 and 52, respectively, whose driving directions are orthogonal to each other, but which employ the eccentric 40 as a common crank for transmitting motion to the feed bar means. In that the linkage assemblies 50 and 52 utilize a common crank, the resulting vector sum of the orthogonal forces applied to the eccentric 40 and thus to the shaft 38, can be readily balanced by a counterweight means 48 suitably fixed on the eccentric 40. Another inherent advantage of the present invention is that the independence of the linkage assemblies allows one mechanism or assembly to be adjusted without effecting the performance of the other. The significance of this feature may readily be appreciated to one skilled in the art.

In its presently preferred construction, the first linkage assembly 50 includes a pitman 54 which at one end embraces the eccentric 40 such that rotation of shaft 38 results in endwise reciprocation of the pitman. At its free end, the pitman is formed with a pair of spaced arms 56. A small stud shaft 58 spans the void between the arms 56 and provides a pivotal connection for two links 60 and 62, each of whose end is embraced by the arms 56 of the pitman. From its pivotal connection with the pitman 54, the link 60 extends rearwardly, in the direction of feed, and is articulated as at point 64 to the feed bar means 32. The second link 62 extends from its pivotal connection with the pitman 54 and is pivotally connected as at 68 to one end of an anchor-link 70, the angular orientation of which is adjusted by a stitch length or feed adjusting mechanism means generally identified by numeral 72. (FIG. 3)

Figures 6, 8:
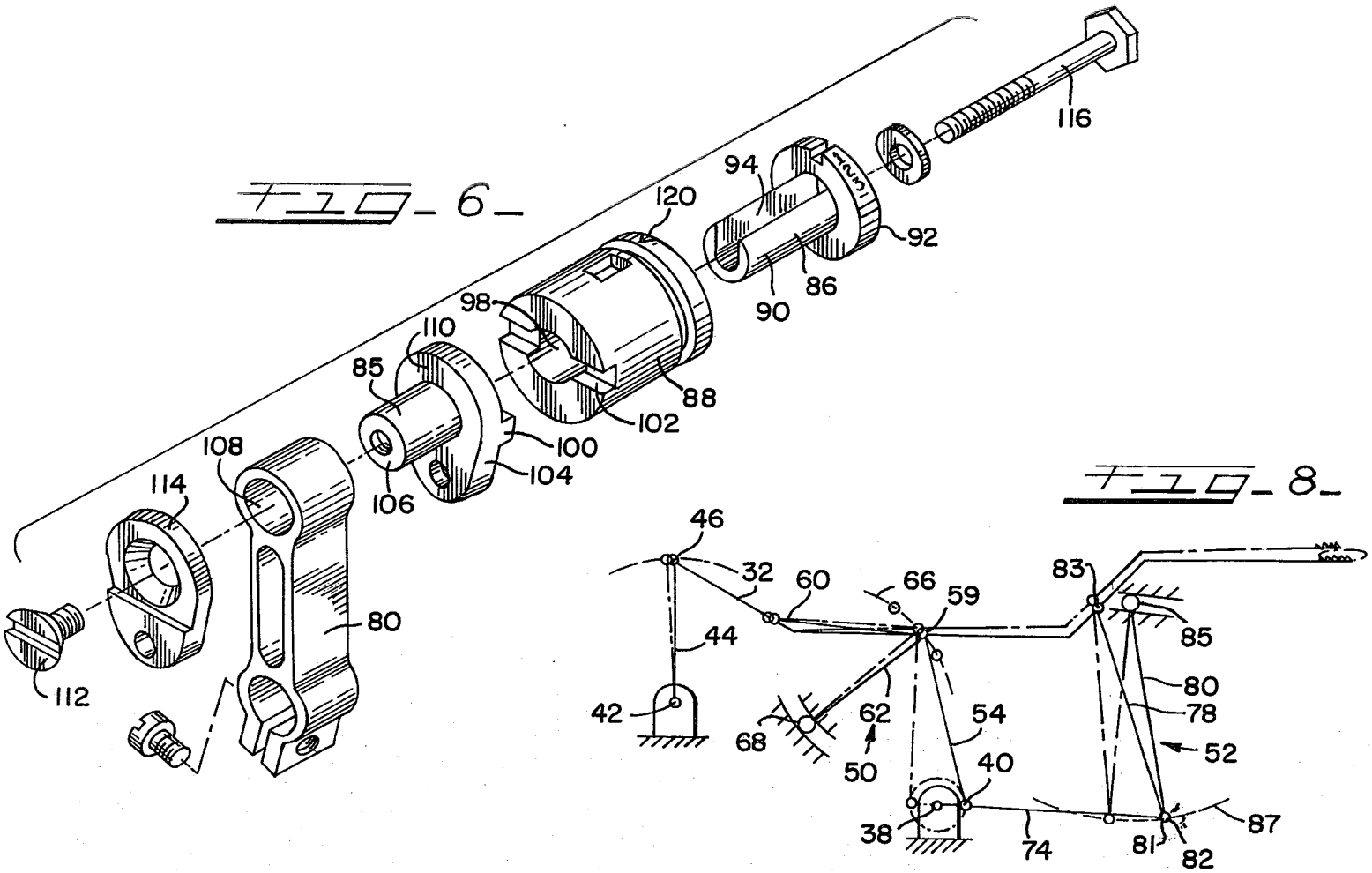
FIG. 6 represents an exploded fragmentary perspective view of the feed regulatory assembly means forming a part of the present invention.
FIGS. 8 and 9 are schematic representations of the improved work feed mechanism in different operative positions.

As may best be viewed in FIG. 8, rotation of shaft 38 is converted into oscillatory motion by the combination of the eccentric 40 and the pitman 54. The point 59 whereat the pitman is pivotally connected to the links 60 and 62 is constrained to move in the arc of a circle, indicated at 66, owing to the positive guiding by the link 62 which, as mentioned, has one end secured to the anchor-link 70. As may be appreciated by one skilled in the art of kinematics and as best seen in FIG. 8, the movement of pitman 54 causes the link 60, through the constained movement of link 62 and pitman 54, to impart a transverse feed motion to the feed bar whereby moving the feed dog means in the horizontal direction so as to impart an advancing motion to the work.

During operation of the machine, the horizontal movement or "feed" that is imparted to the feed bar means and feed dog means through the combined action of the eccentric 40 and the first linkage assembly 50 is superimposed on the vertical movements produced by the combined actions of the common eccentric 40 and the second linkage assembly 52 so that the feed dog means performs an orbital motion in a vertical plane. The second linkage assembly 52 is similar to the first in that it includes a pitman 74 one end of which embraces the eccentric 40. At its free end, the pitman 74 is provided with tines 76 serving to secure a pair of links 78 and 80 about a common pivot point designated 82. As is apparent from the drawings, the links 78 and 80 serve to guide and support the forward end of the feed bar and are pivotally mounted upon a pin or stub shaft 81 which spans the void between the tines 76 of the pitman so as to provide the common pivot point 82 for one end of the links 78 and 80. The opposite end of the link or arm 78 is articulated to the feed bar means 32 at a point designated generally at 83. The opposite end of link 80 is pivotally anchored or fulcrumed as at 85 to an adjustable feed lift regulatory means generally designated as 84, the provision of which allows rising and falling movement to be translated from the eccentric 40 to the feed bar 32 through the subject linkage assembly and is capable of varying the amplitude of feed lift as will be discussed in detail hereinafter.

When considering the kinematics of the second linkage assembly 52, it is evident that the effect of rotating the crank 40 is that movement will be imparted to the pitman 74. As schematically represented in FIG. 8, the movement of the pitman 74 is controlled or affected by the limited arcuate movement of the anchor-link 80 such that the point 82 at which they are connected is constrained to move over the arc 87. The arcuate movement of the anchor-link and its connection with the pitman thereby affects the output of link 78 which, as mentioned, is articulated to the pitman and to the feed bar. As best seen in FIG. 8, the movement of the pitman causes the link 78, through the constrained movement of anchor-link 80 and pitman 74 to impart a "lift" motion which is generally perpendicular to the transverse feed motion whereby raising and lowering the feed dog. It is important to note, that the anchor-link 80 is effective to control the output of the linkage assembly, that is, the path of movement of the connection 82 formed betweem the pitman 74 and the first mentioned link 78, thereby controlling the vertical displacement of the feed bar.

As was mentioned above, in the design of a material feeder mechanism, it is most desirous to provide means for adjusting the feed lift of the machine so as to aid the operator and add versatility to the general performance of the machine. To this end, an advantage of the present invention over the known prior art is the provision of a new and unique feed lift regulatory mechanism generally designated 84 whereby the operator may, at will, govern the amplitude of "lift" that is imparted to the feed dog of the machine. The feed lift regulatory means of the present invention is effectively disposed intermediate the rotary crank 40 and the feed bar 32 and is effective to adjust the operative radius of the crank 40. For purposes of this description, suffice it to say that the operative radius of the crank 40 is that which would normally be effective to import the observed magnitude of movement to the feed bar means; assuming that the fixed lengths of links comprising the linkage assembly remain the same. More particularly, the feed regulatory assembly 84 is effective to control the path of oscillation of the pitman 74 and link 80, thereby controlling the "throw" or movement of link 78 and, hence, the feed lift of the machine.

Figure 2:
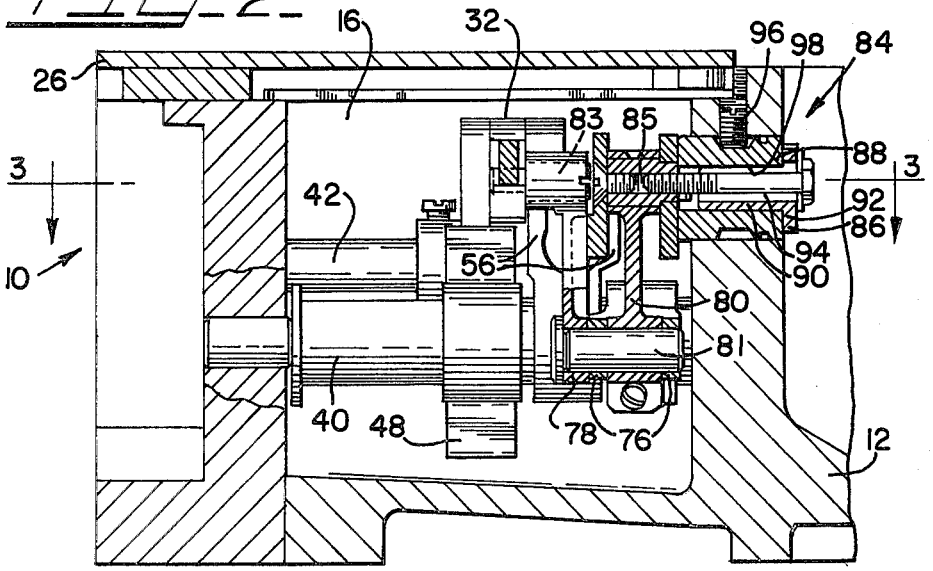
FIG. 2 represents a partial front selectional view taken substantially along the line 2—2 of FIG. 1.

In one presently preferred embodiment, the feed regulatory means 84 is an adjustable device formed by an assembly of an inner member 86 and an outer member 88 telescopically arranged one inside the other in the frame of the machine. The inner member 86 is formed with a sleeve portion 90, a radial flange 92, and a radial or open slot 94 that extends the length of the member. The outer member, which is adapted to be held stationary in the frame of the machine by suitable fastening means, such as 96 (FIG. 2), is provided with a central bore 98 adapted to receive the sleeve portion 90 of the inner member 86. Through mutually engagable parts such as key 100 and keyway 102, member 88 is operatively associated with a feed lift guide block means 104. It should be noted that the keyway is disposed at an acute angle, preferably 5°, relative to the horizontal plane of the work support means. The disposition of the keyway in this position assures that the feed lift may be adjusted symetrically. The guide block means 104 has projecting from the side opposite the key 100, a pin or stub shaft 106 adapted to be received in an aperture 108 provided at the pivotal extremity of anchor-link 80, thus providing the fulcrum or pivot point 85 therefore. The link 80 is held against lateral displacement relative the pin 106 by a shoulder 110 formed on the guide block and a retaining screw 112 adapted to be threadably retained in the guide block 104, a thrust member 114 being disposed between the link 80 and the screw 112.

Figures 7, 9:
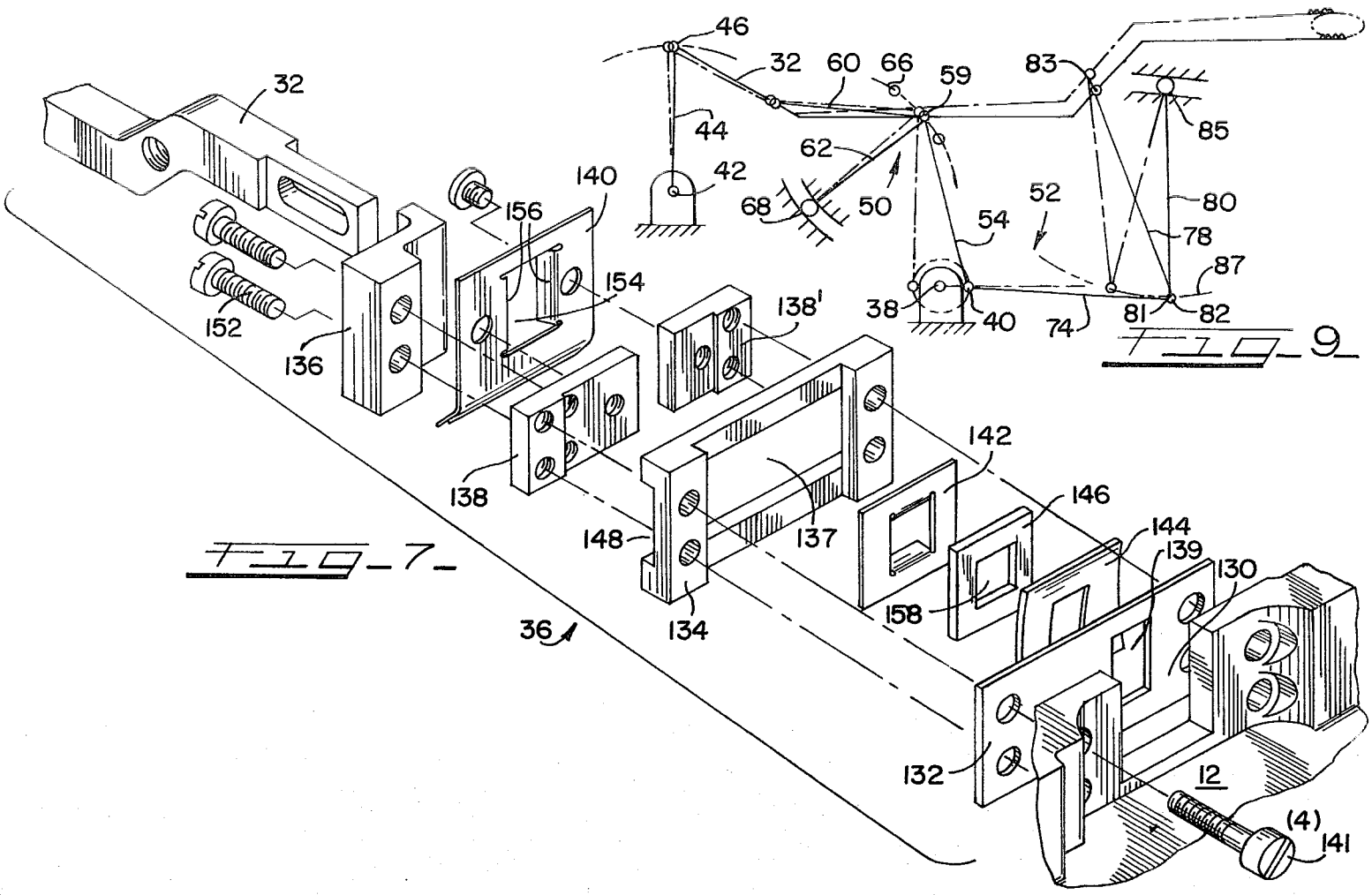
FIG. 7 represents a fragmentary perspective view in exploded form showing a part of the machine.

As is readily apparent to one skilled in the art of kinematics, the disposition of the pivot point or upper extremity of link 80 will determine the path of oscillation of the connection point 82 formed between the pitman 74 and the link 78 and, hence, the magnitude of "lift" that is imparted to the feed mechanism of the machine. When the regulatory mechanism is manually set such that the upper extremity of anchor-link 80 is pivoted about a point 85, as schematically represented in FIG. 8, the straight line approximation of the path traversed by the connection between the pitman 74 and links 78 and 80 is approximately parallel to the plane of the work support and, thus, the vertical displacement of link 78 is relatively small as is reflected in the orbital path of the feed dog means schematically shown in this figure. However, when the position of the pivot point 85 is linearily displaced from the position shown in FIG. 8, to the position shown in FIG. 9, the straight line approximation of path traversed by the connection 82 is altered so that it is at an angle to the work support. Accordingly, the vertical movement of the link 78 is affected, which, in turn, results in a greater amplitude or feed lift being imparted to the feed dog means as is apparent from the change in the orbital path traversed by the feed dog means as schematically represented in FIG. 9. It is important to note, however, that a change in the amplitude of feed lift has no effect on the magnitude of advance and return movements imparted to the feed dog means in view of the independency of the subject linkage assemblies.

In order to obtain the above described and desired result, the feed lift regulatory assembly is manually adjustable so as to enable the operator to selectively shift the pivot point for the anchor link with respect to the shaft 38 in a direction defined by the keyway 102, thus effecting a change in the magnitude of feed lift. To secure the pin 106 and thus the pivot point 85 for the anchor-link 80 in a selectively chosen operative position, a locking member or fastening means 116, which in the preferred embodiment is in the form of a bolt, is provided. The fastening means 116 is captively received in the radial slot 94 of the inner member and has one end threadably engaged with the guide block 104. In this manner, when the fastening means 116 is tightened, it causes the block means to bear against the outer member 88, thus locking the stub shaft 106 from displacement and thereby securing the upper extremity of the anchor-link 80 in an adjustably regulated position.

As shown in FIG. 5, the central or longitudinal axis of the inner and outer member 86 and 88 is indicated at 118, whereas the central axis of the stub shaft 106 and the fastening means threadably engaged therewith are eccentrically positioned in relation thereto as indicated at 120. As mentioned above, and as may be seen in FIG. 5, the fastening means 116 is captively received in the open slot 94 formed in the inner member 86. It will be appreciated that loosening of the fastening means 116 and manual rotation of the inner member will change the position of the fastening means 116 and position of the pin 106 relative the axis of shaft 38 and along keyway 102. It should be noted, that the displacement of pin 116 will be limited to movement along a linear path that is disposed approximately 5° from the plane of the work support means in view of the action of the mutually engageable parts. As mentioned, a change in the placement of the pivot point 85 will influence the "lift" imparted to the feed bar. Once the position of the pivot point 85 has been adjusted, the fastening means is tightened, thus securing the point 85 in an adjustably related position. To facilitate adjustment of the feed regulatory assembly of the invention, a reference mark 120 (FIG. 6) may be formed on the outer member 88 adjacent the radial flange 92. The radial flange 92 of the inner member 86 may have indicia denoted 1, 2, 3 in the drawing, and which are cooperative with the reference mark to denote the desired feed lift selected.

As may possibly best be seen in FIG. 7, the free forward or distal end of the feed bar means 32 extends through a channel or recess 130 provided in the frame of the machine 12. As mentioned earlier, to prevent lubricant from leaking along the feed bar and out of the machine chamber, the machine may be provided with a lubricant sealing device 36. The lubricant sealing device 36 may include a plate member 132, support member 134, guide elements 136 and 138, 138', a series of stripper plates, 140, 142, and 144 and a lubricant sealing element 146.

Both the plate member 132 and the support element 134 are provided with recesses 139 and 137, respectively, through which the forward end of the feed bar means may extend. When assembled, the guides 138 and 138', are captively arranged on one side of the support member 134 in a guide channel 148 and are suitably apertured to receive fastening means 141 and, thus, secure the plate 132 and support member 134 to the frame. The guides 138 and 138', when adjusted properly, are adapted to embrace the sides of the feed bar 132 so that the vertical movement of the bar is guided and are adequate to remove any lubricant therefrom. Secured to the guide means 138 and 138' through suitable fastening means such as 152, is the guide means 136. It should be appreciated that the guide member 136 may act as an additional thrusting surface which aids in controlling the vertical oscillation of the feed bar means 32. Also carried by the guides 138 and 138' is the first in a series of stripper blades, namely, stripper blade 140. The stripper blade 140 is provided with an opening 154 and two flanges, 156 that are adapted to "strip" any lubricant from the sides of the feed bar means 32. As may be seen, the opening 154 is enlarged vertically to permit free lift movement of the feed bar.

To prevent lubricant from escaping through the clearance provided to permit vertical movement of the feed bar, the lubricant sealing device further includes an assemblage of elements composed of two other stripper blades 142 and 144, and a lubricant seal 146. This assemblage of elements is arranged about the feed bar and is allowed freedom of movement in the vertical direction. As seen in the drawing, the subject assemblage is disposed in the area between the plate member 132 and the support member 134 and, thus, may be prevented from horizontal oscillation. In construction, the stripper element 142 is similar to the stripper element 140 with the exception that the element 142 is adapted to remove lubricant from the top and bottom sides of the feed bar means 32. In its presently preferred form, the element 144 may be bowed and is designed to resiliently urge elements 142 and 146 against the support 134. While the stripper blades 140, 142, and 144 may be formed from thin sheet metal, the sealing element 146 is preferably fabricated from a wear resistant sheet material such as polyurethane. The sealing element 146 is of substantially rectangular configuration and is provided with an aperture 158, the dimensions of which confirm to the cross dimensional configuration of the feed bar 32, so as to remove lubricant from all sides of the feed bar 32. By this construction, the individual elements are used in combination so as to prevent lubricant from escaping the machine chamber and, thus, the free end of the feed bar means, extending beyond the frame 10, is maintained relatively free from lubricant.

In operation of the machine, rotary motion of the bed shaft 38 is converted into movement of the feed bar means by the crank 40 and the linkage assemblies 50 and 52. Although the feed bar means and feed dog means carried thereby are given simultaneous vertical and horizontal movement, the magnitude of "lift" is variable. When it is desired to change the magnitude of feed lift, so as to accomodate workpieces of varying thickness or characteristic, the operator selectively adjusts the feed regulatory assembly 84. When the pivot pin 106 of the regulatory assembly 84 is positioned such that the straight line approximation of the connection point is generally parallel to the work support means, the vertical displacement of the feed dog is relatively small. However, when the regulatory assembly is adjusted, hence the pin is linearly displaced, the disposition of the straight line approximation of the connection point is displaced at an angle to the work support means. Thus, a variable path of oscillation may be imparted to the connection between the link 78 and the pitman 74, thereby changing the amplitude of lift movements being imparted to the feed dog means. It is important to remember, that the amplitude of lift transmitted to the feed bar and feed dog means is controlled by the linear position of the pivot pin 85. The set position of the regulatory assembly 84 and, more particularly, the position of the inner member 86 thereof determines the placement of the pivot pin 106, and thus the amplitude of lift.

Numerous alterations of the structure herein disclosed will suggest themselves for those skilled in the art. It is to be understood that this disclosure relates to a preferred embodiment of the invention which is for purposes of illustration only and not to be construed as a limitation of the invention. All such modifications which do not depart from the spirit of the invention are intended to be included within the scope of the appended claims.

What is claimed:

1. A sewing machine having a frame, work support means, revoluble shaft means arranged in said frame beneath said work support means, eccentric means carried by said shaft means and a feed mechanism comprising:

feed bar means;

feed dog means carried thereby; drive mechanism means including a series of connected link means operatively associated with said eccentric means for imparting motion to said feed bar means in mutually perpendicular directions, one direction being transversely across said frame to provide work advancing and return movements, the other direction being toward or away from said work support means so as to lift said feed dog means to a position above said work support means during the work advancing movement and to lower said feed dog means below said work support means during the return movement; and means associated with said drive mechanism means for allowing rising and falling movements to be translated from said eccentric means to said feed bar means including means for modulating the amplitude of lift being imparted to said feed dog means.

2. A sewing machine as recited in claim 1 wherein said means for modulating the amplitude of lift comprises:

member means secured for rotation in the frame of the machine, said member means having an open slot extending the entirety of its longitudinal distance;

guide block means having a pin adapted to provide a pivot point for one of said link means, said pin being eccentrically located relative the central axis of said member means; and operative means captively received in said slot and threadably engaged with said guide block means for positioning said pin at varying distances from the axis of said revoluble shaft means, said distance being a function of the angular orientation of said member means.

3. A sewing machine as recited in claim 2 and further including means fixedly mounted in the frame of the machine for constraining the movement of said guide block means and said pin to movement along a line disposed at an acute angle to the work support means.

4. In a sewing machine having a frame, shaft means mounted for rotation in said frame, stitch forming instrumentalities for forming stitches in a workpiece at a stitching point and an improved feed mechanism means including feed dog means adapted to cooperate with a presser foot assembly in advancing the workpiece past said stitching point, said improved feed mechanism means comprising;

feed bar means having said feed dog means secured to the distal end thereof;

means on said shaft for imparting movement to a linkage assembly means such that vertical movement is imparted to said feed dog means, said linkage assembly means including a pivoted swinging member, the fulcrumed position of which determines the extent of feed lift imparted to said feed dog means; and feed lift regulatory means including means providing the fulcrum for said swinging member, said regulatory means being adapted to control the output motion of said linkage assembly whereby enabling the magnitude of the orbital motion imparted to said feed dog means to be selectively controlled within predetermined limits.

5. An improved feed mechanism for a sewing machine having a frame and a rotary shaft means mounted in said frame, said feed mechanism comprising:

crank means adapted for rotation with said shaft means;

feed dog means carried by a feed bar means for simultaneous horizontal and vertical movements;

connections between said rotary crank and said feed bar means for moving said feed dog means in an orbital path;

first operative means operatively associated with said connections and effectively arranged intermediate said crank means and said feed bar means for changing the operative radius of said crank means; and second operative means for retaining said first operative means against displacement from its adjusted position.

6. A feed mechanism for a sewing machine having a frame, revoluble drive shaft means arranged in said frame, said drive shaft means having a crank portion adapted for rotation therewith, said feed mechanism comprising:

feed bar means having feed dog means operatively secured thereto;

means for converting the rotational movement of said crank portion into simultaneous feed drive and feed lift movements for said feed dog means; and means for changing the amplitude of feed lift imparted to said feed dog means.

7. A sewing machine having a frame, work support means carried by said frame, rotary shaft means mounted in said frame and feed mechanism means adapted to transport a workpiece over said work support means comprising:

feed bar means;

feed dog means carried at the distal end of said feed bar means;

an eccentric drivingly secured to said shaft;

a pitman adapted to be driven by said eccentric;

first link means connecting said pitman to said feed bar means for imparting rising and falling movements to said feed dog means;

an anchor link connected to said pitman and said first link means; and means operative secured in said frame for pivotally supporting the anchor link and for regulating the said pitman and first link means whereby controlling the magnitude of feed lift of the feed mechanism means.

8. A feed lift regulator for sewing machines of the type including a housing, a rotatable shaft and work feed mechanism mounted in said housing, said work feed mechanism including feed bar means and feed dog means carried thereby, a pitman operatively connected to said shaft, means on said shaft for oscillating said pitman, first link means connecting the free end of said pitman to said feed bar means so as to move same in a vertical direction, second link means for controlling the path of movement of the connection between said pitman and said first link thereby controlling the vertical displacement of said feed bar means, said feed lift regulator comprising:

movable pivotal support means adapted to pivotally secure one extremity of said second link means;

operator influenced adjusting means operatively connected to said pivotal support means and adapted to influence the position thereof whereby modulation of said operator influenced means changes the position of the pivotal support means and thus the arcuate path traversed by said second link thereby effecting the feed lift movements imparted to said feed bar means; and means for securing said operator influenced means and said pivotal support means in an adjustably regulated position.

9. A feed lift regulator means for sewing machines of the type including a housing, a rotatable shaft and work feed mechanism mounted in said housing, said work feed mechanism including feed bar means and feed dog means carried thereby, a pitman operatively connected to said shaft, means on said shaft for oscillating the free end of said pitman, first arm means connecting the free end of said pitman to said free bar means so as to move same in a vertical direction, second arm means for controlling the path of movement of the connection between said pitman and said first arm means thereby controlling the vertical displacement of said feed bar, said feed lift regulator means comprising:

guide block means including pivot pin means arranged to pivotally secure one end of said second arm means;

operator influenced adjusting means rotatably mounted in said housing about an axis disposed eccentric from the longitudinal axis of said pivot pin means; and control pin means disposed within a radial slot formed in said operator influenced means and operatively connected to said guide block means whereby rotation of said operator influenced adjusting means changes the position of the pivot pin means and pivot point for said second arm means and thus the path of movement of the connection between the pitman and said first arm means and thereby the magnitude of feed lift imparted to said feed dog means.

10. A feed lift regulator means for sewing machines according to claim 9 and further including guide member for influencing the movement of said guide block means upon rotation of the operator influenced means.

11. A feed lift regulator means for sewing machines according to claim 10 wherein said guide member is received in said housing and is provided with a keyway, said guide block means having a key formed as an integral part thereof, said key being embraced in said keyway so as to influence the movement of said pivot pin means.

12. A feed lift regulator means for sewing machines as recited in claim 11 wherein said operator influenced means is telescopically arranged in and supported by said guide member.

13. In a machine having a reciprocable tool for operating on a workpiece, work support means over which the workpiece is fed with respect to said tool, an orbitally actuated feed member movable height-wise of the work support means and adapted for intermittent engagement with the workpiece so as to feed same in translation when the tool is retraced, an actuating shaft having an eccentric formed as an integral part thereof and mechanism means for orbitally actuating said feed member and capable of modulating the height-wise adjustment of said feed member with respect to said work support means comprising:

operating connections through which orbital motion is imparted to said feed member, said operating connections including a first linkage assembly for imparting horizontal movement to said feed member and a second linkage assembly for simultaneously imparting feed lift movements to said feed member;

said second linkage assembly includes a pitman actuated by said eccentric, a link connecting said pitman to said feed member and an anchor-link for controlling the path of movement of the connection between said pitman and said first mentioned link;

feed lift regulatory means including pin means to which said anchor-link is pivoted, said pin means being supported by a guide block, the position of which determines the orientation of the path traversed by the connection between the link and the pitman relative to the work support means; and means for varying the set position of said pin means whereby effecting the orientation of the path traversed by the connection between the link and the pitman relative to the work support means and, hence, the magnitude of feed lift imparted to said feed member.

14. In a sewing machine having a frame, work support means including throat plate means for supporting the material to be sewn, said throat plate means being provided with a plurality of openings, revoluble shaft means including an eccentric fixedly mounted in said frame and a material feeder mechanism mounted in same frame beneath said work support means including a material engaging gripper member movable through the openings provided in said throat plate means and capable of varying the vertical movements of said gripper member relative to said throat plate means comprising:

first linkage assembly means operatively connected to said eccentric for imparting horizontal feed advancing movements to said gripper member;

second linkage assembly means operatively connected to said eccentric for simultaneously imparting vertical lifting movements to said gripper member, said last mentioned means including a pivotal swinging member the fulcrumed position of which is determinative of the amplitude of lift imparted to said gripper member;

a normally stationary bearing block means including a pin means providing the fulcrum for said pivotal swinging member; and adjusting means operatively associated with said bearing block means for varying the set position of said pin means whereby effecting the displacement of said pivotal swinging member thereby modifying the amplitude of feed lift movements imparted to said gripper member.

15. A sewing machine as recited in claim 14 further including fastening means for securing said pin means in any selected range of positions.

16. A feeding mechanism for a machine comprising:

feed bar means;

feed dog means carried thereby;

an operating shaft;

eccentric means coupled in a driven relationship to said operating shaft;

a first linkage system connected to said feed bar means and actuated by said eccentric means for imparting feeding movements to said feed dog means;

a second linkage system including a series of connected links adapted to be actuated by said eccentric means for supporting said feed bar means and for imparting lift movements to said feed dog means; and operative means effectively interposed between said eccentric means and said feed bar means for controlling the output of said second linkage system, said operative means including means for varying the output of said second linkage system thereby changing the amplitude of lift imparted to said feed dog means.

17. In a sewing machine having a frame, stitch forming instrumentalities for forming a seam at a stitching location, shaft means having a crank portion rotatably mounted in said frame and an improved feed mechanism means including feed bar means and feed dog means carried thereby for transporting a workpiece in increments past said stitching location and capable of varying the feed lift, comprising:

means actuated by said crank portion for imparting feed and return movements to said feed dog means; feed lift mechanism means actuated by said crank portion for supporting said feed bar means and for giving to it feed lift movements in synchronism with its feed and return movements, said feed lift mechanism means comprising:

a pitman connected to said crank portion for deriving motion therefrom;

a first link connected to said pitman and said feed bar means, the movement of which is adapted to impart feed lift movements to said feed dog means;

a second link for translating the motion of said pitman into movement of said first mentioned link; said second link being supported for pivotal rotation about a pivot point provided for by a feed lift regulatory assembly means; and feed lift regulatory assembly means arranged in said frame for providing the pivot point for said second link means, feed lift regulatory means includes manually operable means for selectively shifting the pivot point for said second link with respect to said shaft whereby a variable path of oscillation may be imparted to the connection between said first mentioned link and the pitman thereby changing the amplitude of lift movements being imparted to said feed dog means.

18. A sewing machine as recited in claim 17 wherein said feed lift regulatory assembly means comprises:

an outer member secured in the frame of the machine;

an inner member telescopically arranged relative to said outer member and formed with a radial flange adapted to abut against one side of said outer member, said inner member having an open slot extending the entireity of its length;

guide block means arranged on the other side of said outer member, said guide block means having extending therefrom a stub shaft disposed eccentric from the central axis of said inner member and defining the pivot point for said second link, the guide block means and outer member including mutually engageable parts by means of which said stub shaft may be displaced along a linear path; and fastening means captively received in the open slot of said inner member and threadably engaged with said guide block to position and lock said stub shaft in a selected position.

19. A sewing machine as recited in claim 18 further comprising indicia carried on the radial flange of said inner member for denoting the selected feed lift motion.

20. A sewing machine having a frame, work support means, revoluble shaft means arranged in said frame beneath said work support means and a feed mechanism comprising:

feed bar means having feed dog means carried thereby; at least two separate drive mechanism means each of which includes a series of connected link means that use a common crank arranged on the revoluble shaft means for imparting motion to said feed bar means in generally orthogonal directions, one direction being transversely across said bed to provide work advancing and return movements, the other direction being toward or away from said work support means to lift said feed dog means to a position above said work support means during the work advancing movement and to lower said feed dog means below said work support means during the return movement;

feed lift regulator means for modulating the amplitude of lift being imparted to said feed dog means; and counterweight means for balancing the vector sum of the orthogonal forces applied to said shaft as a result of the actuation of said drive mechanism means.

* * * * *